US010141682B2

(12) United States Patent
Williams et al.

(10) Patent No.: US 10,141,682 B2
(45) Date of Patent: Nov. 27, 2018

(54) SUBSEA ELECTRICAL CONNECTOR WITH REMOVABLE ROV MATING TOOL

(71) Applicant: Teledyne Instruments, Inc., Thousand Oaks, CA (US)

(72) Inventors: Corey C. Williams, Port Orange, FL (US); Justin Kretschmar, Port Orange, FL (US); Richard Jones, Sanford, FL (US)

(73) Assignee: Teledyne Instruments, Inc., Thousand Oaks, CA (US)

( * ) Notice: Subject to any disclaimer, the term of this patent is extended or adjusted under 35 U.S.C. 154(b) by 0 days.

(21) Appl. No.: 15/386,966

(22) Filed: Dec. 21, 2016

(65) Prior Publication Data

US 2018/0175542 A1 Jun. 21, 2018

(51) Int. Cl.

| | |
|---|---|
| ***H01R 13/627*** | (2006.01) |
| ***H01R 13/523*** | (2006.01) |
| ***H01R 13/631*** | (2006.01) |
| ***H01R 13/641*** | (2006.01) |
| ***H01R 43/26*** | (2006.01) |

(52) U.S. Cl.

CPC ..... *H01R 13/523* (2013.01); *H01R 13/6271* (2013.01); *H01R 13/631* (2013.01); *H01R 13/641* (2013.01); *H01R 43/26* (2013.01)

(58) Field of Classification Search

CPC .... H01R 13/523; H01R 43/26; H01R 13/641; H01R 13/6271; H01R 13/631; A61B 17/068; E21B 33/1243

USPC ..... 439/357

See application file for complete search history.

(56) References Cited

U.S. PATENT DOCUMENTS

| | | | | |
|---|---|---|---|---|
| 4,616,900 | A | 10/1986 | Cairns | |
| 4,666,242 | A | 5/1987 | Cairns | |
| 4,682,848 | A | 7/1987 | Cairns et al. | |
| 4,795,359 | A | 1/1989 | Alcock et al. | |
| 4,917,619 | A | 4/1990 | Nishiwaki | |
| 5,194,012 | A | 3/1993 | Cairns | |
| 5,685,727 | A | 11/1997 | Cairns | |
| 5,738,535 | A | 4/1998 | Cairns | |
| 5,838,857 | A | 11/1998 | Niekrasz | |
| 6,315,461 | B1 | 11/2001 | Cairns | |
| 6,554,636 | B2 | 4/2003 | Walker et al. | |
| 6,615,923 | B1 | 9/2003 | Lay, Jr. et al. | |
| 6,736,545 | B2 | 5/2004 | Cairns et al. | |
| 6,902,199 | B2 | 6/2005 | Colyer et al. | |
| 7,150,325 | B2 | 12/2006 | Ireland et al. | |
| 7,690,433 | B2 | 4/2010 | Reynolds | |
| 7,695,301 | B2 | 4/2010 | Mudge, III et al. | |
| 8,297,883 | B2 | 10/2012 | Masters et al. | |
| 8,869,661 | B2 | 10/2014 | Opstad | |
| 8,900,000 | B2 | 12/2014 | Cairns | |
| 9,801,626 | B2 * | 10/2017 | Parihar | A61B 17/068 |
| 2008/0087436 | A1 | 4/2008 | Baskett | |
| 2012/0328371 | A1 | 12/2012 | Munstereifel et al. | |

(Continued)

*Primary Examiner* — Jean F Duverne

(74) *Attorney, Agent, or Firm* — Duncan Galloway Egan Greenwald, PLLC; Kevin T. Duncan

(57) ABSTRACT

The present invention relates to a robotically manipulatable wet-mateable subsea connection system suitable for use in harsh subsea environments. The robotically manipulatable wet-mateable subsea connection system of the present invention comprises a bulkhead receptacle unit, a flying lead plug unit, and a removable, reusable, robotically manipulatable connection tool.

18 Claims, 15 Drawing Sheets

(56) References Cited

U.S. PATENT DOCUMENTS

| | | | | |
|---|---|---|---|---|
| 2013/0213660 | A1 | 8/2013 | Misuraca et al. | |
| 2014/0196953 | A1* | 7/2014 | Chitwood ..... | E21B 33/1243 175/57 |
| 2014/0270645 | A1 | 9/2014 | Toth | |
| 2016/0301212 | A1 | 10/2016 | Germain et al. | |

* cited by examiner

SUBSEA ELECTRICAL CONNECTOR WITH REMOVABLE ROV MATING TOOL

FIELD OF THE INVENTION

The present invention relates generally to subsea power and data connection systems suitable for use in harsh environments. More particularly, the present invention relates to a robotically manipulatable, wet-mateable subsea connection system suitable for use in harsh subsea environments.

BACKGROUND OF THE INVENTION

In offshore drilling and production operations, equipment is often subjected to harsh conditions thousands of feet under the sea surface with working temperatures of −50° F. to 350° F. with pressures of up to 15,000 psi. Subsea control and monitoring equipment commonly are used in connection with operations concerning the flow of fluid, typically oil or gas, out of a well. Flow lines are connected between subsea wells and production facilities, such as a floating platform or a storage ship or barge. Subsea equipment includes sensors and monitoring devices (such as pressure, temperature, corrosion, erosion, sand detection, flow rate, flow composition, valve and choke position feedback), and additional connection points for devices such as down hole pressure and temperature transducers. A typical control system monitors, measures, and responds based on sensor inputs and outputs control signals to control subsea devices. For example, a control system attached to a subsea tree controls down-hole safety valves. Functional and operational requirements of subsea equipment have become increasingly complex along with the sensing and monitoring equipment and control systems used to insure proper operation.

To connect the numerous and various sensing, monitoring and control equipment necessary to operate subsea equipment, harsh-environment connectors are used with electrical cables, optical fiber cables, or hybrid electro-optical cables. Initial demand for subsea connector development was in connection with military applications. Over time demand for such connectors has grown in connection with offshore oil industry applications.

Early underwater connectors were electrical "dry-mate" devices, intended to be mated prior to immersion in the sea and were of two principal types: rubber-molded "interference fit" type and rigid-shell connectors. The rubber molded "interference-fit" connectors depended on receptacles with elastic bores that stretched and sealed over mating plugs. The rigid-shell connectors had mating parts sealed together via O-rings or other annular seals.

However, there was a demand for connectors that could also be mated in the subsea environment. These so called "wet-mate" connectors were adaptations of the interference-fit dry-mate versions, and were designed so that when mated, the water contained in the receptacle bores would be substantially expelled prior to sealing. Additionally, oil-filled and pressure-balanced electrical connector designs were introduced which isolated the receptacle contacts within sealed oil-chambers which, during engagement, were penetrated by elongated pins with insulated shafts. Connection was, therefore, accomplished in the benign oil, not in harsh seawater. The oil-filled connectors provide one or more seals that allow the oil chambers to be penetrated repeatedly without losing the oil or allowing seawater intrusion.

There are many types of connectors for making electrical and fiber-optic cable connections in hostile or harsh environments, such as undersea or submersible connectors which can be repeatedly mated and de-mated underwater at great ocean depths. Current underwater connectors typically comprise releaseably mateable plug and receptacle units, each containing one or more electrical or optical contacts or junctions for engagement with the junctions in the other unit when the two units are mated together. Each of the plug and receptacle units or connector parts is attached to cables, which may be referred to as flying leads, or other devices intended to be joined by the connectors to form completed circuits. To completely isolate the contacts to be joined from the ambient environment, one or both halves of these connectors house the contacts in oil-filled, pressure-balanced chambers—this is referred to as a pressure balanced set-up. Such devices are often referred to as "wet-mate" devices and often are at such great depths that temperature and other environmental factors present extreme conditions for materials used in such devices. The contacts on one side (plug) are in the form of pins or probes, while the contacts or junctions on the other side (receptacle) are in the form of sockets for receiving the probes. Examples of prior dry-mate, wet-mate, and pressure compensated wet-mate connector systems that have been used in subsea environments are described in U.S. Pat. Nos. 4,616,900; 4,682,848; 4,666,242; 4,795,359; 5,194,012; 5,685,727; 5,738,535; 5,838,857; 6,315,461; 6,736,545; and U.S. Pat. No. 7,695,301, each of which is incorporated herein in its entirety.

In these prior art connection systems, either the plug and receptacle components of the connection system must be mated on the surface in the case of the dry-mate connection systems or in the subsea environment in the case of wet-mate connection systems. For wet-mate connection systems, the connections may be mateable by a diver if the connection is at a shallow enough depth that it can be reached by a diver using suitable equipment. For connections at greater depths or connections in more hazardous conditions, a remote operated vehicle ("ROV") is typically used. Many types of ROVs exist, but most that are employed in the subsea oil and gas extraction industry typically have one or more robotic manipulators. These manipulators are typically not very complex, and may only comprise a vise-like or pliers-like gripper or manipulator only having two digits, of which only one may be movable. More advanced robotic manipulators exist, however, even these may not be able to properly operate overly complicated connection systems in subsea conditions where temperature, fluid turbulence, or low visibility may impair operation.

To this end, typical connection systems usually feature a robotically manipulatable component on the plug unit part of the connection system. For example, the plug unit in the connection system described in U.S. Pat. App. 2014/0270645 entitled COMPOSITE CONNECTION SYSTEM, to Toth, which is incorporated by reference herein in its entirety, provides a plug unit having a robotically manipulatable handle disposed at the rear of the plug unit. The handle in Toth is a fixed assembly that is not removable from the plug unit and is fastened, semi-permanently, to the plug unit. This means that each plug unit used in the system in Toth, like most prior art systems, must have its own robotically manipulatable handle.

In systems like the one described in Toth, the flying connection unit must be designed and constructed to withstand forces exerted on the flying connection unit by manipulation of the handle during mating and de-mating procedures. For example, when the flying connection unit is being mated with the receptacle unit, axial and radial forces may be applied to the housing or shell of the flying connection unit that could fracture the flying connection unit, compromising the pressure integrity of the flying connection unit itself. This type of pressure integrity loss would render the flying connection unit unusable and would require a complete replacement of the flying connection unit which would necessitate bringing the flying connection unit to the surface for repairs. Such a repair would be costly and time consuming. Furthermore, in order to design the flying connection unit to withstand the forces of mating and de-mating exerted on the plug unit by the handle, the flying connection must be designed to be robust and strain or stress resistant. This design increases the cost of the flying connection unit because of the type and amount of material that must be used to make the flying connection unit sufficiently robust. For example, the flying connection unit would need to be made of a suitable metal that could withstand the strain of mating and de-mating exerted on the flying connection unit housing by the attached handle. Moreover, providing each flying connection unit with its own handle significantly increases the cost and complexity of each flying connection unit.

What is needed is an improved flying lead connection system having a removable robotically manipulatable tool that provides for greater flexibility, is robust and less subject to breakage resulting from plug manipulation and has a reduced cost and complexity for each plug unit in the connection system.

SUMMARY OF THE INVENTION

Embodiments described herein provide a new connection system having a removable, robotically manipulatable tool for ROV mate-able subsea applications.

The present invention comprises a robotically manipulatable, reusable mating tool to reduce the cost of an ROV mateable, wet-mate connector system. The use of the reusable mating tool of the new ROV connector of the present invention incorporates cost saving design features. These features include, but are not limited to, a plastic flying connector shell, a plastic termination shell, and a new joining method for the connector and termination shell. The present invention both reduces the cost of an ROV connection system and reduces overall system complexity.

Specifically, the present invention provides a new, lower-cost ROV wet-mateable connector system as well as a new reusable mating tool to be used with the connector system. The plug unit portion of the connector system interfaces with the reusable mating tool during ROV mating and demating. The reusable mating tool provides for mating and de-mating alignment and withstands the ROV mating loads. This allows the plug unit of the flying ROV connector of the present invention to incorporate lower-strength plastic components and still be robust and reliable. The new bulkhead connector incorporates the necessary features to interface with the reusable mating tool. The reusable mating tool is removed and recovered after the connectors are mated.

The robotically manipulatable, reusable mating tool of the present invention comprises features which provide for a detachable interface with the plug unit of the flying ROV connector. The robotically manipulatable reusable mating tool also comprises features which provide for alignment with the bulkhead mounted connector. The robotically manipulatable reusable mating tool aligns with and provides compliance for the plug unit of the flying ROV connector and is adequately strong to withstand ROV mating loads. The robotically manipulatable reusable mating tool provides a method for ROV manipulation and is detachable, recoverable, and re-usable.

The ROV connector system of the present invention is significantly lower in cost than standard ROV electrical connectors in part because it comprises a polymer or polymer composite flying connector shell and termination shell. The ROV connector system also comprises a reusable mating tool which allows for the attachment to and removal from the plug unit of the flying ROV connector in place of the ROV handle used in prior art systems. Additionally, the ROV connector system of the present invention provides for increased strength at the connector interface and at the attachment or mating point of the flying connector shell and termination shell.

The ROV connector system of the present invention reduces the complexity and cost when compared to prior art systems. For example, the present invention does not incorporate slide shell and latch fingers that are found in prior art systems. The present invention comprises a simplified latching method and latching indication which comprises at least canted coil springs and a high visibility painted surface. The ROV connector system of the present invention may utilize any commercially available connection components such as Teledyne Nautilus modules, termination shells, and hose fittings.

In a first embodiment, the present invention provides a robotically mateable connector system comprising: a first connector unit, a second connector unit, and a robotically manipulatable tool; the first connector unit comprising a housing; the second connector unit comprising a front shell, a rear shell, and a mating shell disposed within the front shell, the rear shell further comprising a rear shell back; the robotically manipulatable tool comprising a tool body having a top and a bottom and a tool body opening, and a grip assembly, the grip assembly comprising a grip handle disposed at the top of the robotically manipulatable tool, the robotically manipulatable tool further comprising an interior socket adapted to fit about the second connector unit rear shell back; and wherein the robotically manipulatable tool is releaseably attachable to the second connector unit and, when attached to the second connector unit, is adapted to place the second connector unit in a mated condition with the first connector unit.

The system of the first embodiment may further comprise wherein the front shell and the rear shell of the second connector unit comprise a polymer material. The first connector unit may further comprise a flange base and a mating collar that may also comprise a mating keyway. The mating shell of the second connector unit may further comprise a mating key, wherein the mating keyway of the first connector unit is adapted to receive the mating key of the second connector unit to provide for alignment of the first connector unit and second connector unit during a mating operation. The mating collar of the first connector unit may further comprise a latching indication. The mating collar of the first connector unit may further comprise a set of tool keys. The robotically manipulatable tool may further comprise a set of tool keyways. The system of claim 1 wherein the system further comprises a flying lead, the flying lead disposed at and joined to the rear shell of the second connector unit. The robotically manipulatable tool may further comprise a flying lead guide, the flying lead guide adapted to provide alignment of the robotically manipulatable tool with the second connector unit. The housing of the first connector unit may comprise a polymer material. The mating shell of the second connector unit may further comprise a set of locking tabs and the first connector unit further comprises a latching spring disposed within the first connector unit housing, the latching spring adapted to secure the mating shell of the second connector unit within the first connector unit housing in a mated condition.

In a second embodiment, the present invention provides a reusable robotically manipulatable tool comprising: a tool body having a top and a bottom and a tool body opening; a grip assembly, the grip assembly comprising a grip handle disposed at the top of the robotically manipulatable tool and joined to the robotically manipulatable tool by a handle collar; and an interior socket adapted to receive a connector unit shell.

The reusable robotically manipulatable tool of the above embodiment may further comprise wherein the tool body further comprises a flying lead guide disposed at the bottom of the tool body and adapted to receive a flying lead and provide for mating alignment with the flying lead. The tool body may comprise a polymer material. The grip assembly may further comprise a handle extension and a handle mount block, the handle extension disposed between the grip handle and the handle mount block and the handle mount block disposed on the handle collar. The handle collar may comprise an upper handle collar and a lower handle collar. The tool body may comprise a set of tool keyways, the tool keyways adapted to provide for mating alignment with a bulkhead connector during a mating operation. The reusable robotically manipulatable tool is may further be adapted to releaseably attach to a rear shell of a connector unit to provide for the manipulation of the connector unit during a mating or de-mating operation with a bulkhead connector.

BRIEF DESCRIPTION OF THE DRAWINGS

In order to facilitate a complete understanding of the present invention, this system, and the terms used, reference is now made to the accompanying drawings, in which like elements are referenced with like numerals. These drawings should not be construed as limiting the present invention or system, but are exemplary and for reference.

DETAILED DESCRIPTION

The present invention and system will now be described in more detail with reference to exemplary embodiments as shown in the accompanying drawings. While the present invention and system is described herein with reference to the exemplary embodiments, it should be understood that the present invention and system is not limited to such exemplary embodiments. Those possessing ordinary skill in the art and having access to the teachings herein will recognize additional implementations, modifications, and embodiments as well as other applications for use of the invention and system, which are fully contemplated herein as within the scope of the present invention and system as disclosed and claimed herein, and with respect to which the present invention and system could be of significant utility.

Figure 1:
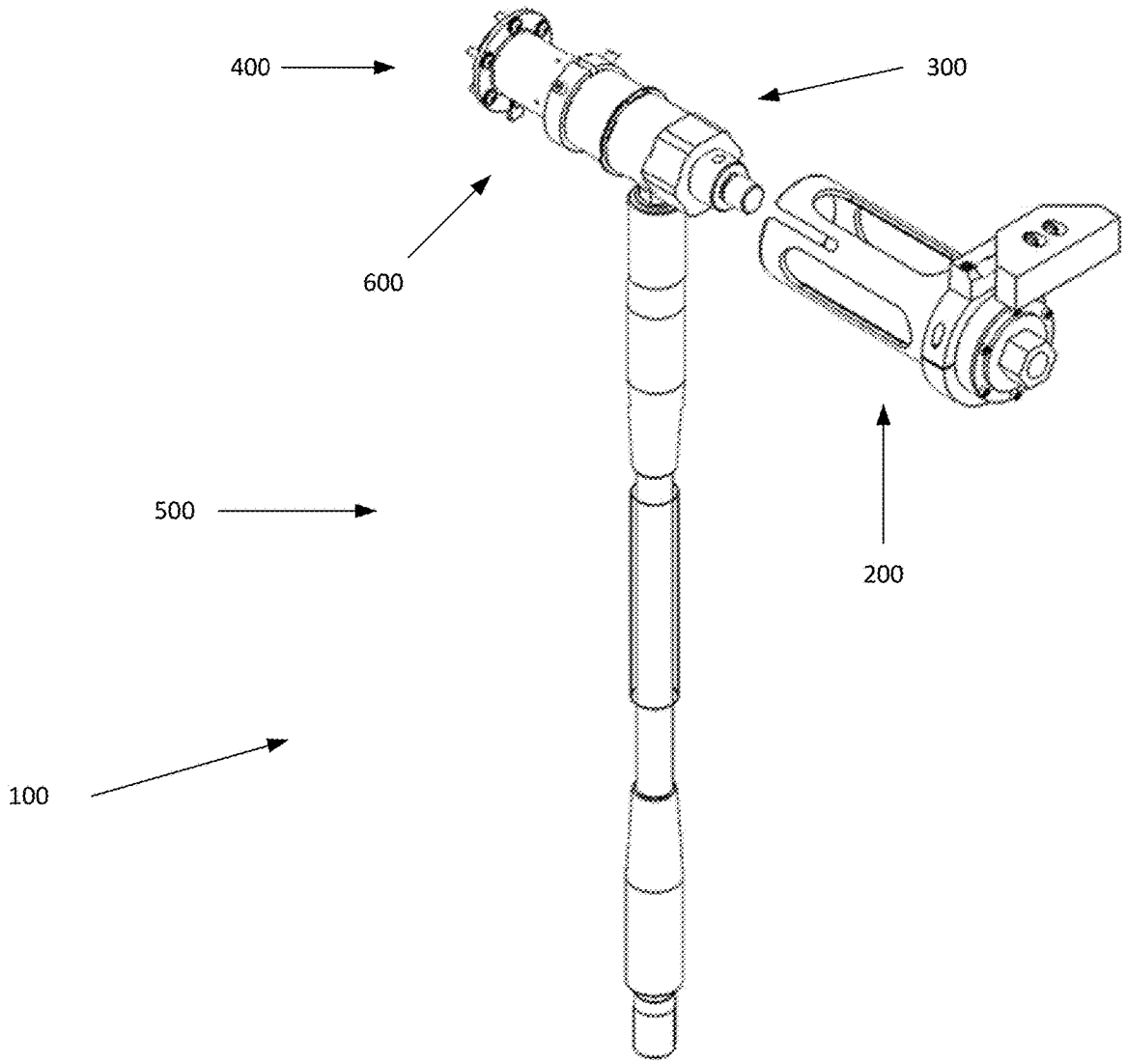
FIG. 1 provides a top perspective view of an embodiment of the robotically manipulatable connector system 100 according to the present invention.

With reference first to FIG. 1, a top perspective view of the robotically manipulatable connection system ("RMCS") 100 is provided. The RMCS 100 comprises a robotically manipulatable reusable mating tool 200, plug unit 300, receptacle unit 400, and flying lead 500. The mated plug unit 300 and receptacle unit 400 comprise the mated connection 600. In this disclosure the plug unit 300 and receptacle unit 400 are referred to as a plug and receptacle respectively, however, the functionality of each of the plug unit 300 and receptacle unit 400 could be switched such that the receptacle unit 400 performed a "plug" function and the plug unit 300 performed a "receptacle function."

The plug unit 300 and receptacle unit 400 of the RMCS 100 may comprise any type of connection suitable for subsea systems such as electrical power connections, Ethernet connections, CAN bus data connections, optical information connections, optical power transmission, etc. The receptacle unit 400 is typically mounted on a bulkhead or other fixed subsea structure and enables the connection provided by the mated connection 600 to pass through the bulkhead or other fixed structure. Typically, this enables the connection to pass through a bulkhead that separates a stable interior environment from a harsh exterior environment, such as exists at great depths subsea. The connection is provided by the flying lead 500, which may be any suitable subsea cable such as an oil-filled, pressure-balanced cable. The flying lead 500 may be connected to any source such as a subsea power distribution unit, subsea Ethernet hub, or subsea modular connectorized distribution unit.

The reusable mating tool 200 is a robotically manipulatable tool that enables a remotely operated vehicle ("ROV") to manipulate the plug unit 300 into a mated connection with the receptacle unit 400. The reusable mating tool 200, plug unit 300, and receptacle unit 400 each comprise features that, together, provide for easy mating and de-mating of the plug unit 300 and receptacle unit 400. In prior art systems, the features provided by the reusable mating tool 200 would typically all be included into the plug unit 300. In the present invention, by moving certain features from the plug unit 300 to the reusable mating tool 200, the RMCS 100 provides for a more cost-effective solution when compared to prior art systems.

Figure 2:
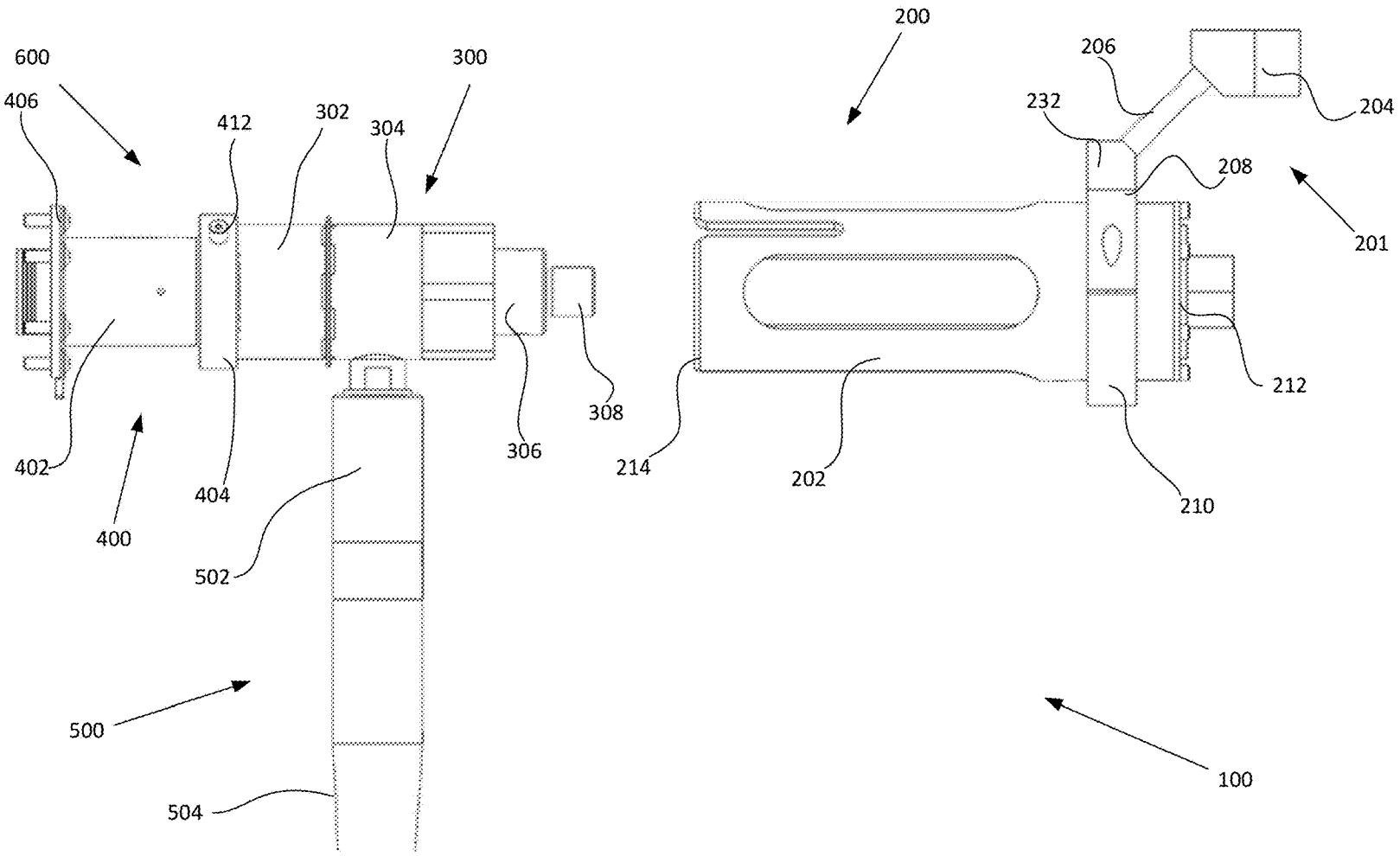
FIG. 2 provides a side view of the robotically manipulatable connector system 100 according to the present invention.

With reference now to FIG. 2, a side view of the RMCS 100 is provided. FIG. 2 shows the plug unit 300 and receptacle unit 400 together in a mated condition as mated connection 600. The reusable mating tool 200 is separate from the mated connection 600 as it would be after a mating or before a de-mating procedure. The receptacle unit 400 comprises substantially cylindrical receptacle housing 402, a mating collar 404 that is raised from and typically thicker than the receptacle housing 402, and a flange base 406 that would be disposed on the exterior of a bulkhead or other fixed subsea structure. The plug unit 300 comprises a termination shell or front shell 302, a flying connector shell or rear shell 304, plug tool pin housing 306, and plug tool pin 308. The flying lead 500 is disposed at the bottom of the plug unit 300 and comprises a cable termination 502 and strain relief 504. The flying lead 500 may be any commercially available lead suitable for use in a harsh subsea environment.

The reusable mating tool 200 comprises the grip assembly 201, tool body shell 202, upper handle collar 208, lower handle collar 210, and captured nut 212. The grip assembly 201 comprises the grip handle 204, the handle extension 206, and the handle mount block 232. The tool body shell 202 further comprises the tool body opening 214. The tool body shell 202 of the reusable mating tool 200 may be composed of a polymer or polymer composite material or may be comprised of a suitable metal. By moving the grip assembly 201 to the reusable mating tool 200 from the plug unit 300 the materials required for both the reusable mating tool 200 and plug unit 300 do not have to be as stress and strain resistant compared to prior art methods wherein the grip is placed directly on the plug unit. The reusable mating tool 200 may also be used in mating and demating operations multiple times by a ROV and is removed from the plug unit after a mating or demating procedure is completed.

Figure 3:
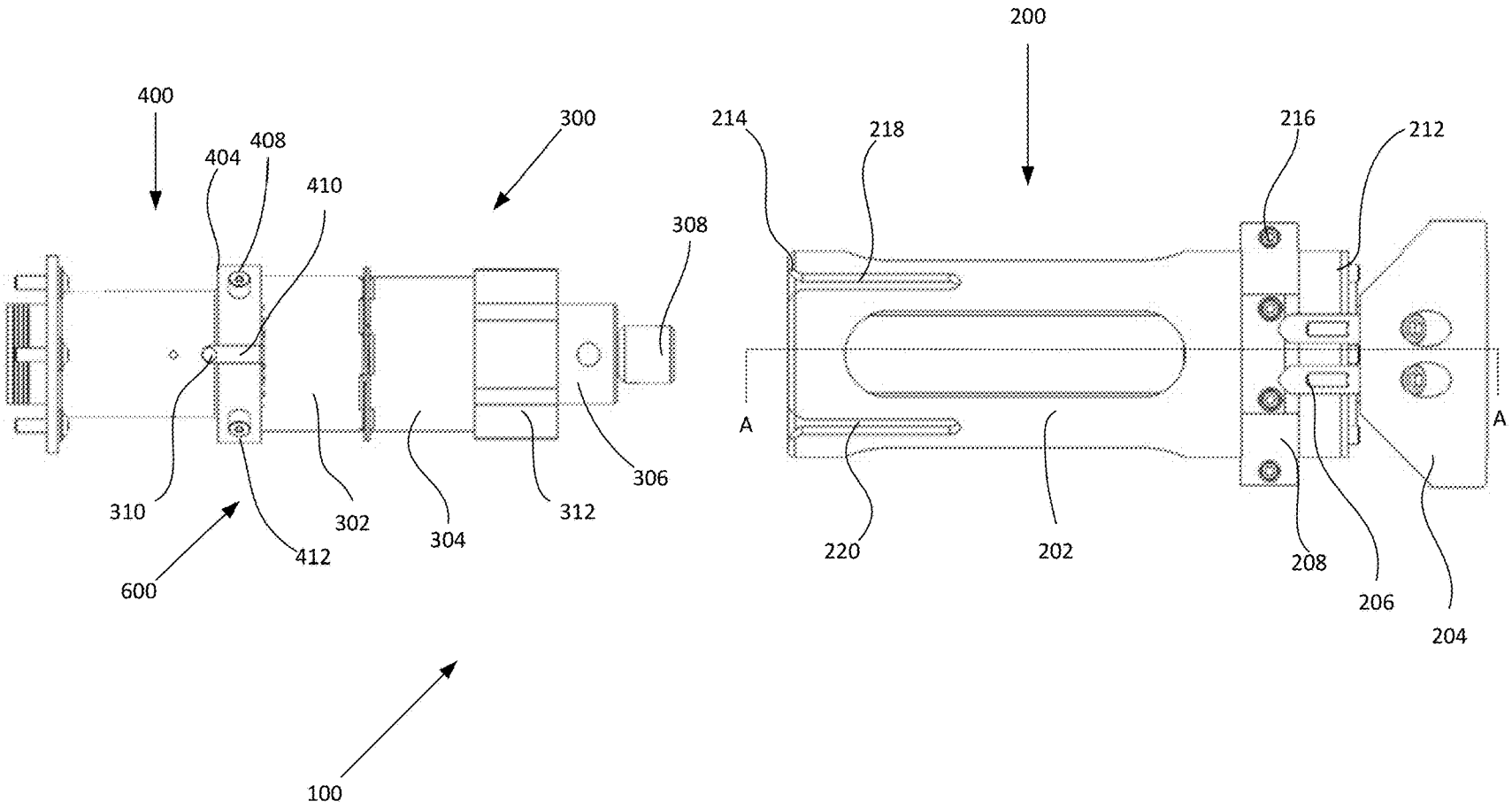
FIG. 3 provides a top view of the robotically manipulatable connector system 100 according to the present invention.

With reference now to FIG. 3, a top view of the robotically manipulatable connector system 100 according to the present invention is provided. The plug unit 300 is aligned with the receptacle unit 400 by the mating key 310 in the mating keyway 410. Tool keys 408 and 412 on the mating collar 404 provide for alignment of the tool mating keyways 218 and 220 in the tool body shell 202 of the reusable mating tool 200 with the receptacle unit 400 during mating and demating operations. The rear shell back 312 of the rear shell 304 of the plug unit 300 may be octagonal, hexagonal, pentagonal, or another suitable shape like that of a nut such that it mechanically fits within the tool interior socket 236 (shown in FIG. 8) of the reusable mating tool 200. The plug tool pin housing 306 houses and secures the plug tool pin 308 that fits within and mechanically engages with the tool socket recess 234 (also shown in FIG. 8) of the reusable mating tool 200. The plug tool pin 308 may be an extension or extrusion from the rear of the plug unit 300 that may have a threaded exterior or other means of engaging with a similarly and correspondingly configured tool socket recess 234 and captured nut opening 228 (shown in FIG. 9).

Figure 4:
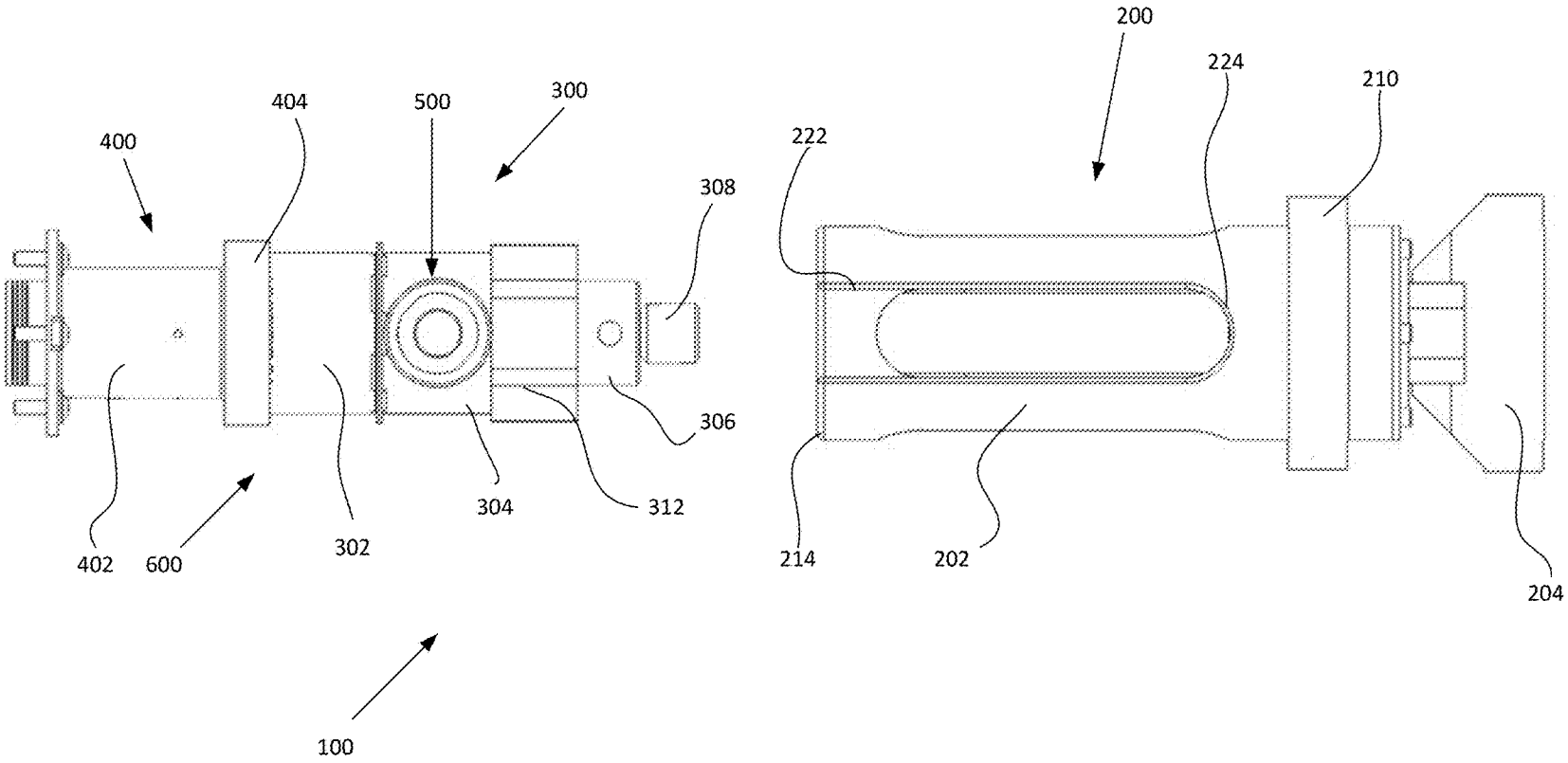
FIG. 4 provides a bottom view of the robotically manipulatable connector system 100 according to the present invention.

With reference now to FIG. 4, a bottom view of the robotically manipulatable connector system 100 according to the present invention is provided. The flying lead 500 disposed at the bottom of the plug unit 300 provides for an electrical, data, or optical connection with other subsea or surface equipment. When the reusable mating tool 200 is fully engaged with the plug unit 300, the flying lead 500 will have passed through the flying lead guide 222 of the tool body shell 202 to abut the flying lead guide end 224. This positioning ensures complete engagement of the reusable mating tool 200 with the plug unit 300, but alignment of the reusable mating tool 200 with the plug unit 300 is provided for is provided by the mating keys 408 and 412 and mating keyways 218 and 220 shown in FIG. 3.

Figure 5:
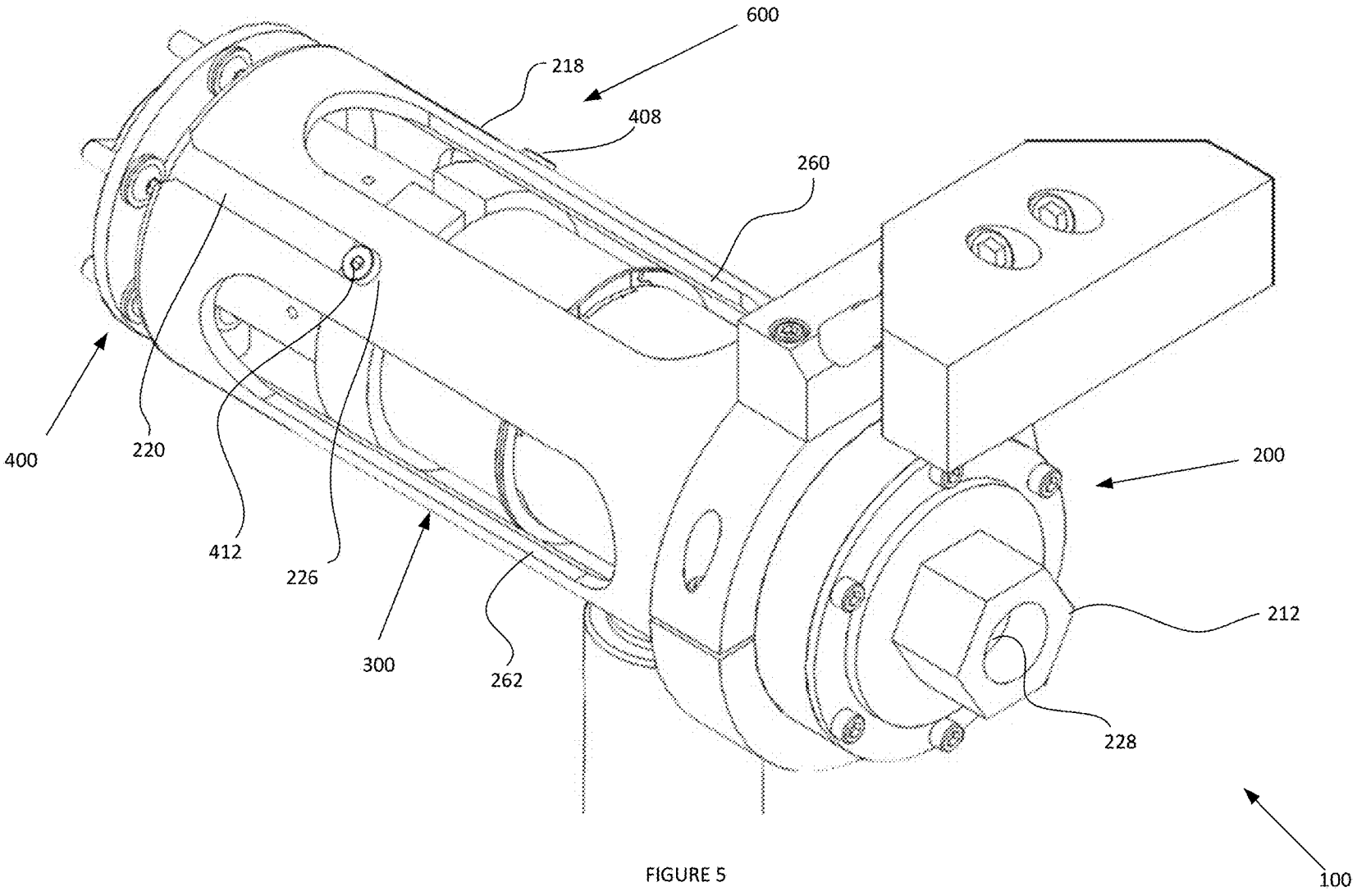
FIG. 5 provides a top perspective view of the robotically manipulatable connector system 100 with the reusable mating tool 200 engaged with the plug unit 300 according to the present invention.
Figure 6:
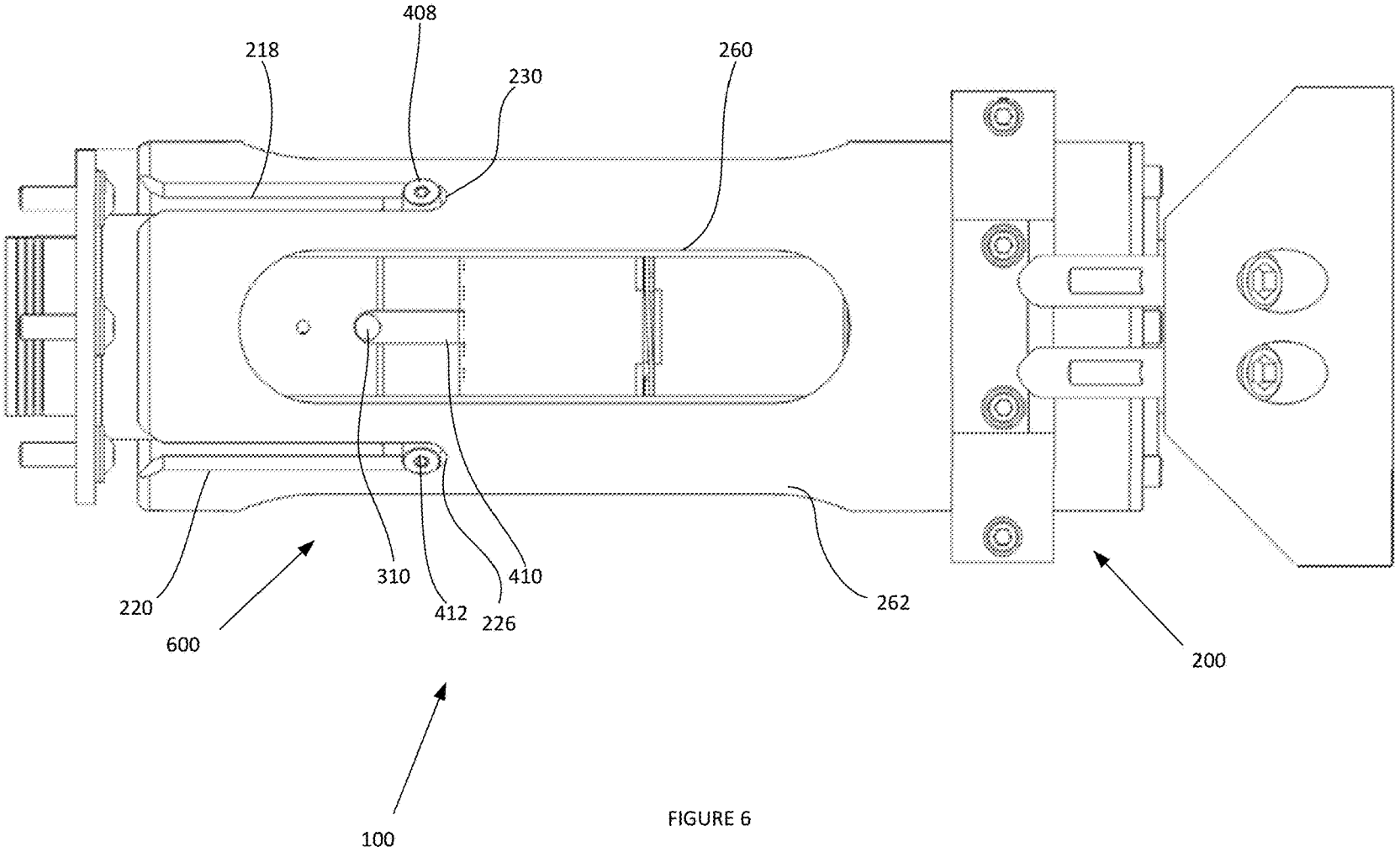
FIG. 6 provides a top view of the robotically manipulatable connector system 100 with the reusable mating tool 200 engaged with the plug unit 300 according to the present invention.
Figure 7:
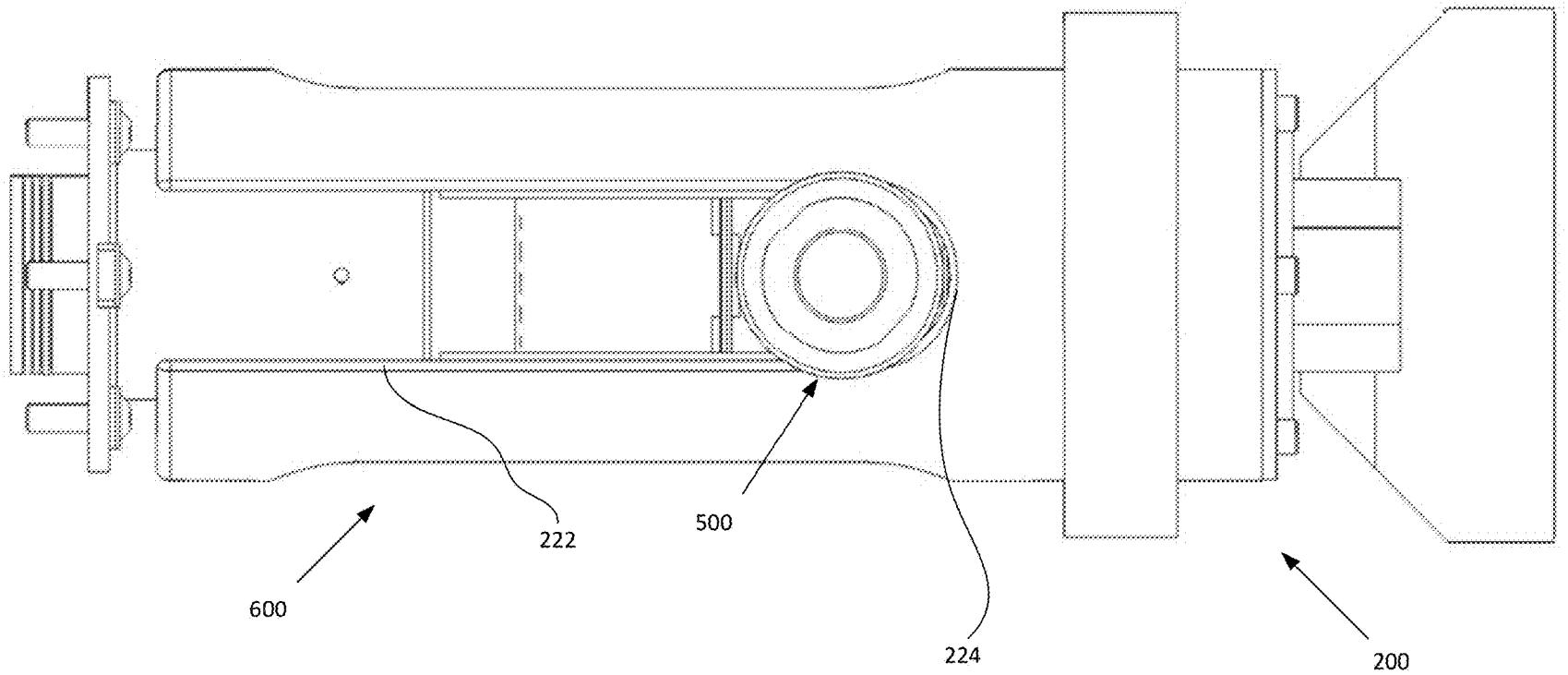
FIG. 7 provides a bottom view of the robotically manipulatable connector system 100 with the reusable mating tool 200 engaged with the plug unit 300 according to the present invention.

FIGS. 5-7 provide views of the reusable mating tool 200 in an engaged position or state with the plug unit 300 and also positioned over the receptacle unit 400. FIGS. 5-7 illustrate the position of the reusable mating tool 200 with respect to the mated connection 600 immediately prior to a demating operation or immediately following a mating operation.

With reference now to FIG. 5, a top perspective view of the robotically manipulatable connector system 100 with the reusable mating tool 200 engaged with the plug unit 300 according to the present invention is provided. The reusable mating tool 200 is shown fully engaged with the plug unit 300 and positioned respective to the receptacle unit 400 as it would be immediately following a mating procedure or immediately preceding a demating procedure. The reusable mating tool 200 will have been positioned as shown in FIGS. 5-7 by a ROV and will have been guided into position by the tool keys 412 and 408 in the tool mating keyways 218 and 220, to ensure proper alignment with the receptacle unit 400 and the flying lead 500 in the flying lead guide 222 as shown in FIG. 7. The tool key 412 is shown fully abutting the tool mating keyway end 226 indicating that the reusable mating tool 200 is properly positioned respective to the plug unit 300 and receptacle unit 400. The captured nut 212 of the reusable mating tool 200 may be manipulated by a ROV to either secure or release the plug unit 300 from the interior of the reusable mating tool 200. When operated, the captured nut 212 secures the plug unit tool pin 308 of the plug unit 300 (shown in FIG. 10).

With reference now to FIG. 6 a top view of the robotically manipulatable connector system 100 with the reusable mating tool 200 engaged with the plug unit 300 according to the present invention is provided. The reusable mating tool 200 when in the engaged position with the plug unit 300 is properly oriented with the receptacle unit 400 by the tool keys 408 and 412 in the tool mating keyways 218 and 220. In the engaged position, tool keys 408 and 412 abut the tool mating keyway ends 230 and 226 respectively. A tool body shell top opening 260 and a set of tool body shell side openings 262 enable an operator of an ROV a view of the mated connection 600. Specifically, these openings enable an operator to see orientation and mating indications such as the mating key 310 and the mating keyway 410 to enable to operator to determine when the plug unit 300 and receptacle unit 400 are properly aligned and either fully mated or fully demated.

With reference now to FIG. 7, a bottom view of the robotically manipulatable connector system 100 with the reusable mating tool 200 engaged with the plug unit 300 according to the present invention is provided. The reusable mating tool 200 engaged with the plug unit 300 is positioned over the mated connection 600. The flying lead 500 is oriented in operation with the flying lead guide 222 of the reusable mating tool 200 by the mating keys 408 and 412 and mating keyways 218 and 220 (shown in FIG. 6) to provide for positioning and alignment of the reusable mating tool 200 with the plug unit 300.

Figure 8:
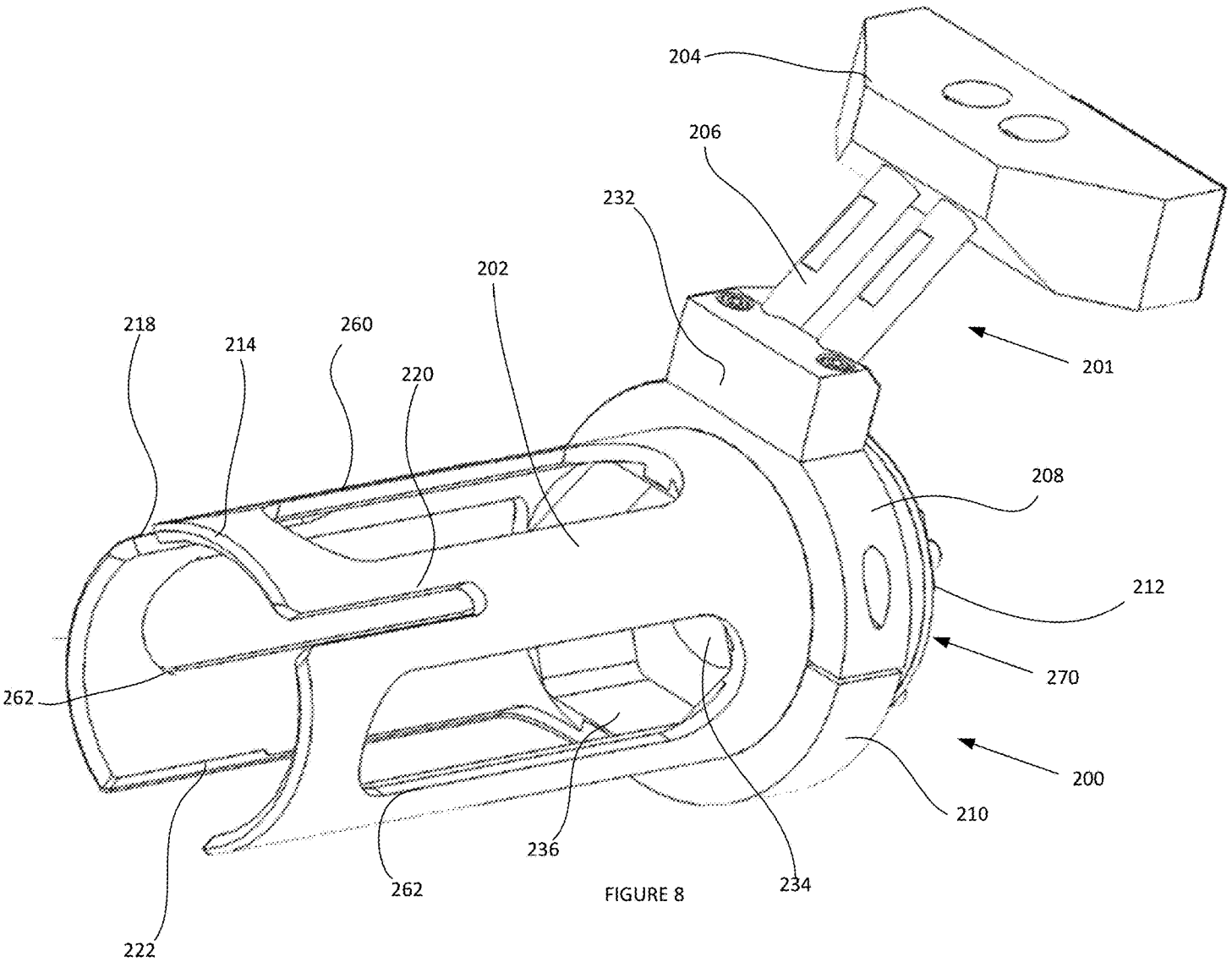
FIG. 8 provides a front perspective view of the reusable mating tool 200 according to the present invention.

With reference now to FIG. 8, a front perspective view of the reusable mating tool 200 according to the present invention is provided. The reusable mating tool 200 primarily comprises the tool body shell 202, the grip assembly 201, and the captured nut assembly 270. The grip assembly 201 comprises a grip handle 204, handle extension 206, and handle mount block 232. The grip handle 204 is positioned apart from the tool body shell 202 by handle extensions 206. The handle extensions 206 are secured to the handle mount block 232 which is secured to the tool body shell 202 by the upper handle collar 208 and lower handle collar 210 which surround the substantially cylindrical shape of the tool body shell 202. The tool body shell 202 may be primarily comprised of polymer or polymer composite material to make the reusable mating tool 200 lighter and less expensive to manufacture. The tool body shell 202 comprises a tool body shell top opening 260, a set of tool body shell side openings 262, a tool body opening 214, tool mating keyways 218 and 220, flying lead guide 222, and tool interior socket 236. The tool body shell top opening 260, a set of tool body shell side openings 262 enable an operator to view the mating and demating procedures without having the tool body shell 202 obstruct the view. The tool mating keyways 218 and 220 and flying lead guide 222 provide for orientation and alignment with the plug unit 300 and receptacle unit 400 during mating and demating procedures. The tool body opening 214 receives the plug unit 300 and receptacle unit 400 within the tool body shell 202. The tool interior socket 236 has a geometric shape corresponding to the rear shell back 312 of the plug unit 300 to prevent rotation of the plug unit 300 within the reusable mating tool 200. The components that comprise the captured nut assembly 270 including the tool socket recess 234 are shown in greater detail in FIG. 9.

Figure 9:
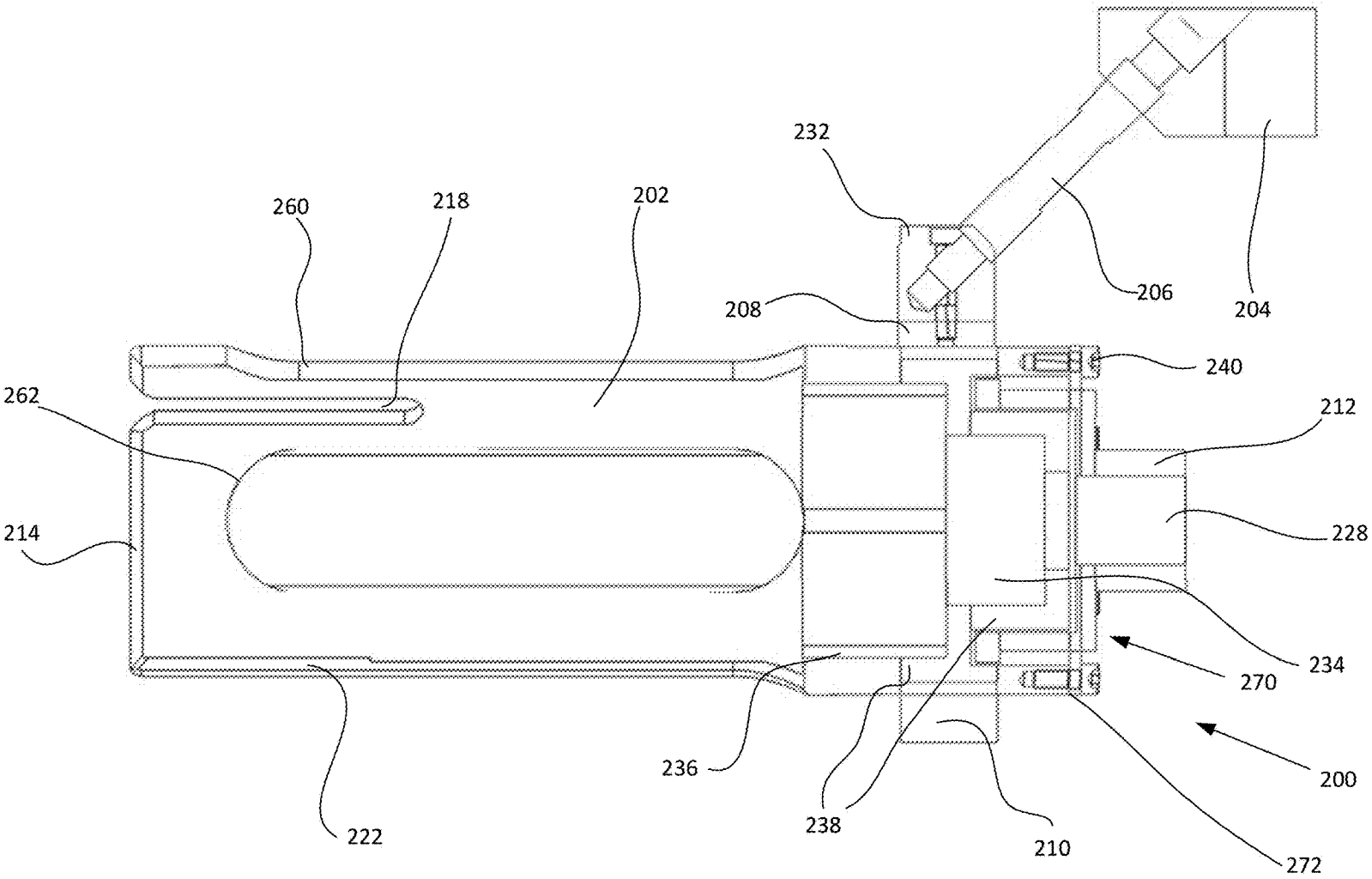
FIG. 9 provides a lateral cross-section view of the reusable mating tool 200 according to the present invention.

With reference now to FIG. 9, a lateral cross-section view of the reusable mating tool 200 according to the present invention is provided. The cross-section view of the reusable mating tool 200 is about the axis A shown in FIG. 3. The captured nut assembly 270 of the reusable mating tool 200 engages with and operates on the plug tool pin 308 of the plug assembly 300. The captured nut assembly 270 comprises the captured nut 212 having captured nut opening 228 which is secured within the tool body shell 202 by a set of captured nut fasteners or cap screws 240 which fasten the retaining plate 272 to the tool body shell 202, and further comprises a tool socket spacer 244, tool socket bushing 242, and tool socket recess 234. The rear shell back 312 of the plug unit 300 (shown in FIGS. 2-3) is received within the tool interior socket 236 and then, when the captured nut 212 is manipulated by an ROV, the components of the captured nut assembly 270 operate to secure or release the plug tool pin 308 of the plug unit 300, securing or releasing the plug unit 300 (shown in FIGS. 2-3) from the reusable mating tool 200. For example, referring to FIGS. 9, 10, and 15, in one embodiment the captured nut 212 may have a threaded interior captured nut opening 228 that engages with a threaded exterior of the plug tool pin 308. The plug tool pin shaft 318 of the plug tool pin 308 is retained within the plug tool pin housing 306 by a compliance bushing 373. Other suitable means may be used for capturing and engaging the plug tool pin 308 by the captured nut assembly 270.

Figure 10:
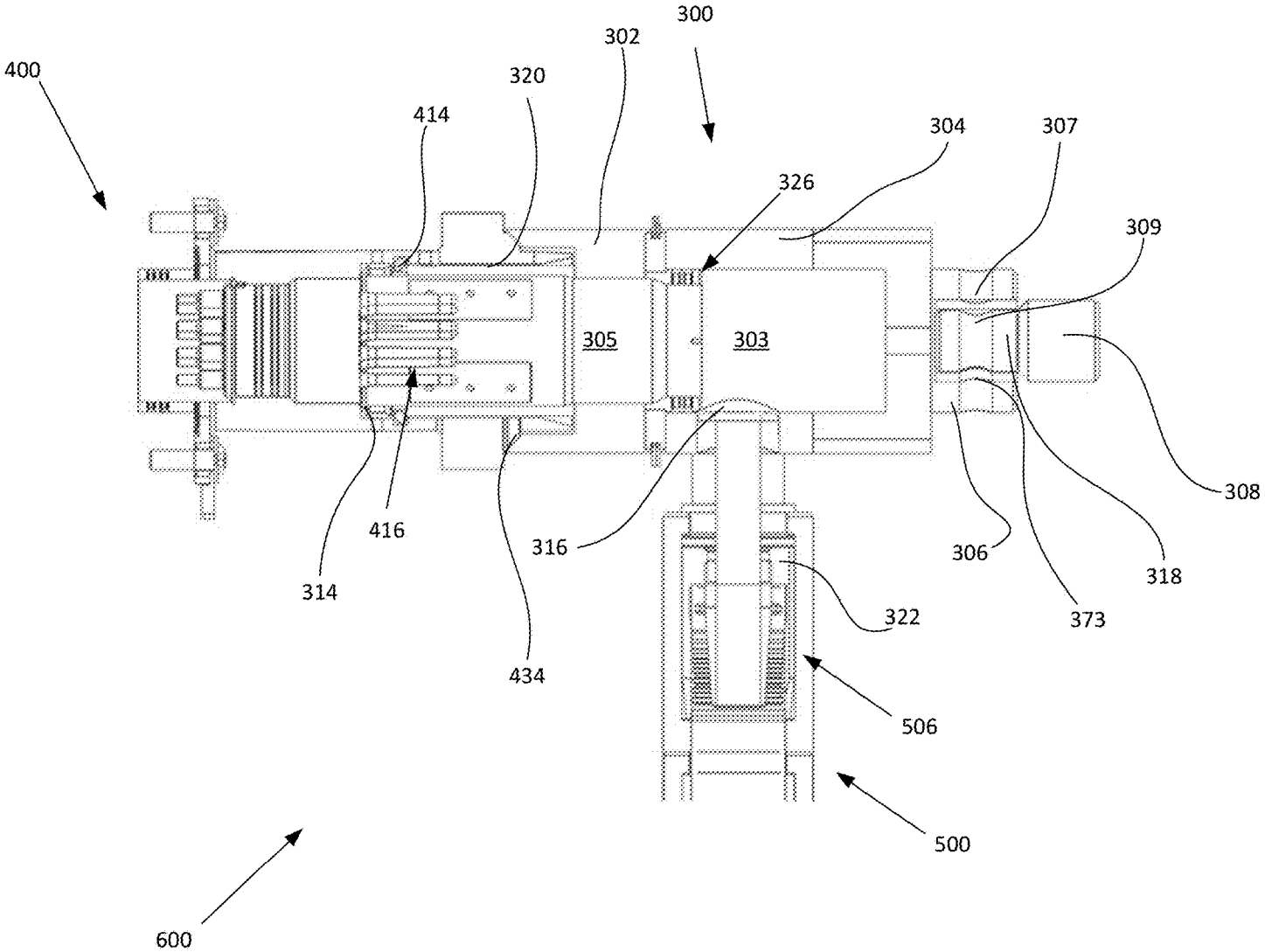
FIG. 10 provides a lateral cross-section view of the mated connection 600 of the receptacle unit 400 and the plug unit 300 according to the present invention.

With reference now to FIG. 10, a lateral cross-section view of the mated connection 600 of the receptacle unit 400 and the plug unit 300 according to the present invention is provided. The cross-section view shows the interior of the plug unit 300 and receptacle unit 400 when the plug unit 300 forms a mated connection 600 with the receptacle unit 400. The flying lead 500 is connected with or joined to the plug unit 300 at the hose nut or hose fitting 322. The hose nut 322 secures the flying lead 500 to the plug unit 300 and the bend restrictor 506 may guide a cable pigtail in the flying lead 500 into the cable pigtail guide 316 of the plug unit 300. In the plug unit interior 303 the cable pigtail would pass through to the mating shell interior 305 and be connected to a set of electrical contacts which would correspond to the set of receptacle pins 416. An interior seal is formed by the plug interior O-rings 326 between the plug mating shell 320 and the rear shell 304. The mating shell retaining grooves 314 are shown engaged with the canted-coil latch spring 414, securing the plug unit 300 and the receptacle unit 400 in a mated condition. Protrusions 307 in the plug tool pin housing 306 secure the plug tool pin 308 by interfacing with corresponding indentations 309 in the plug tool pin 308. The latching indication 434 of the receptacle unit 400 is shown fully covered by the front shell 306 of the plug unit 300 thereby indicating that the plug unit 300 is fully mated with the receptacle unit 400.

Figure 11:
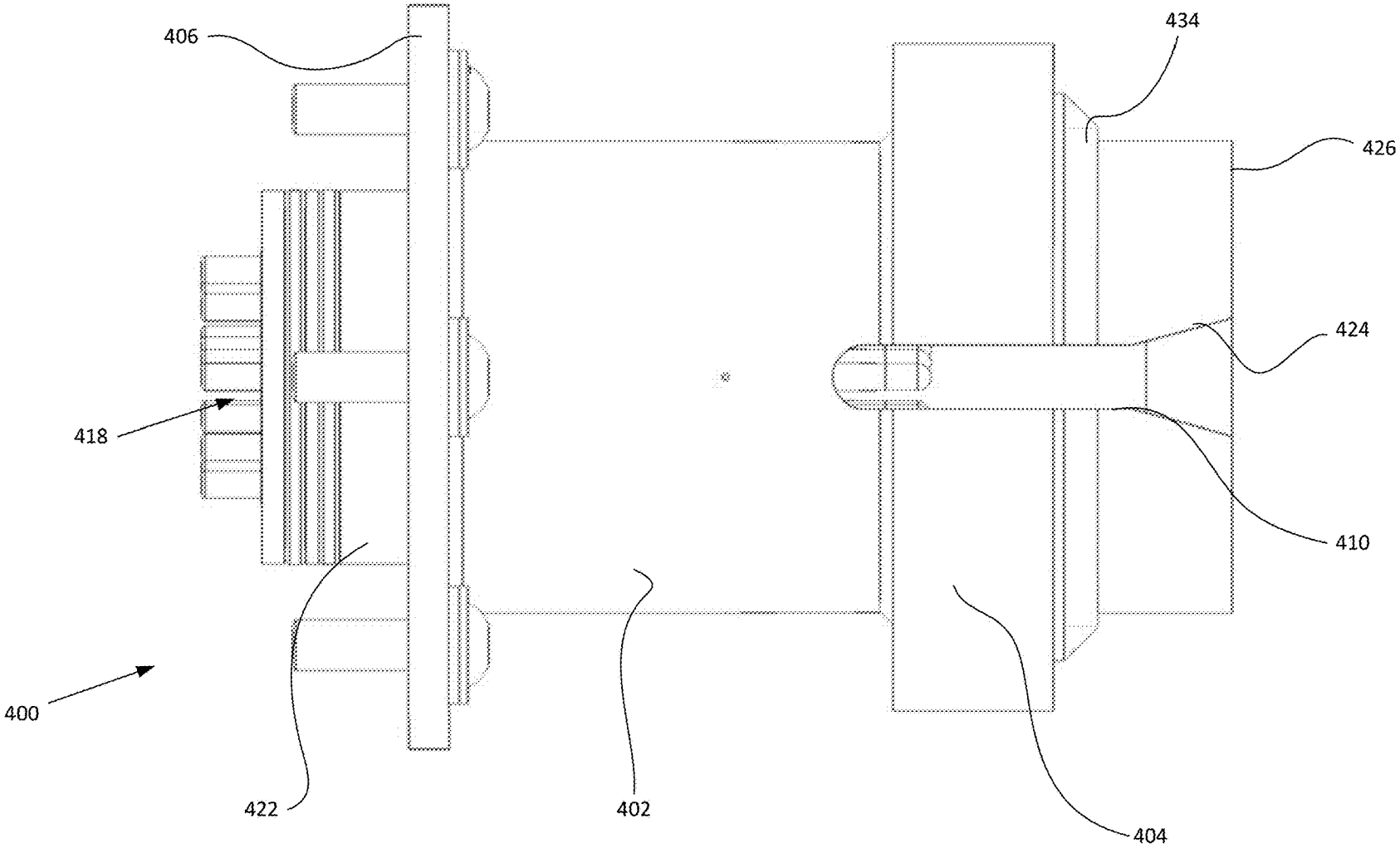
FIG. 11 provides a top view of the receptacle unit 400 according to the present invention.
Figure 15:
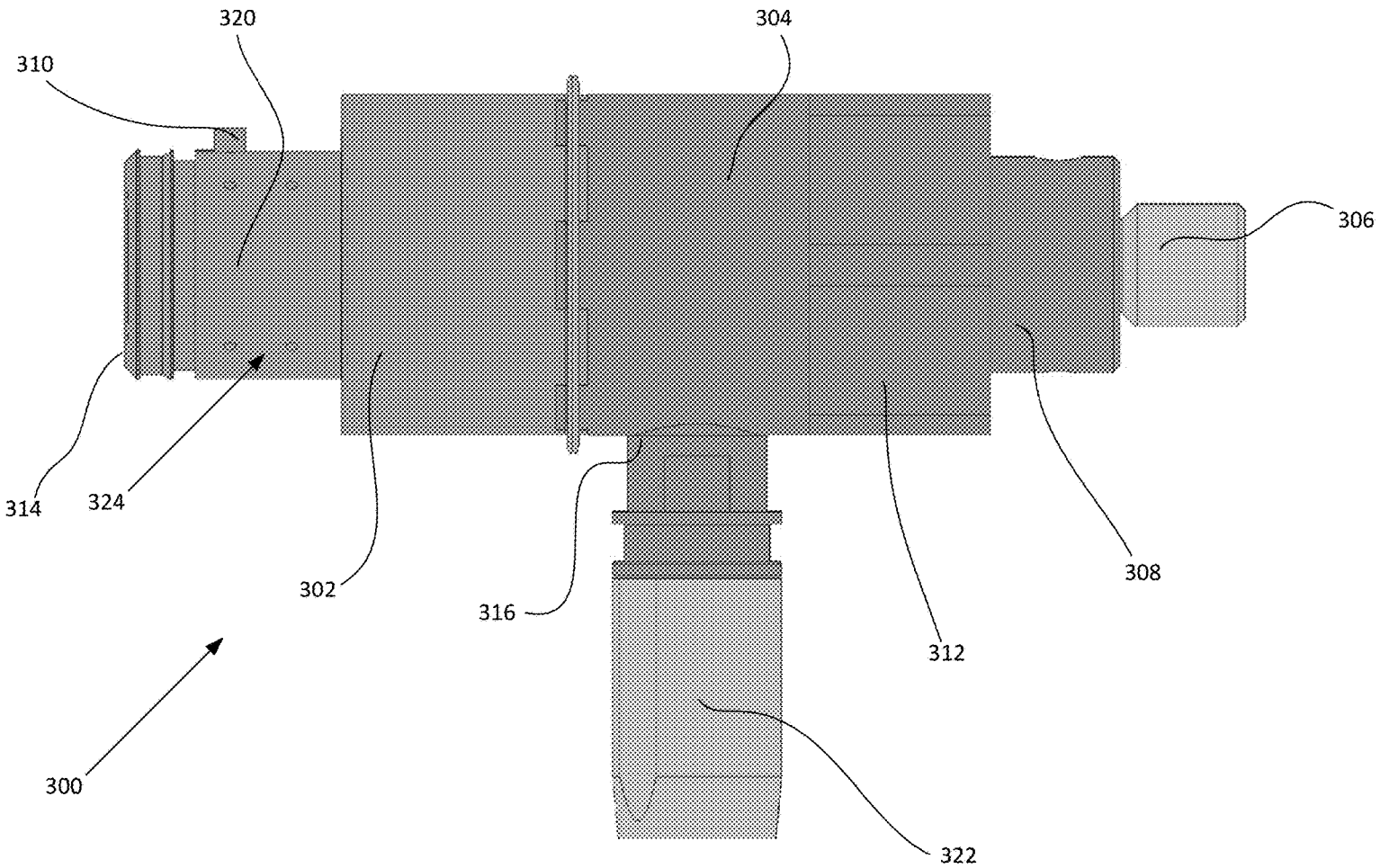
FIG. 15 provides a side view of the plug unit 300 according to the present invention.

With reference now to FIG. 11, a top view of the receptacle unit 400 according to the present invention is provided. The receptacle unit 400 comprises a receptacle housing 402, mating collar 404, flange base 406 and bulkhead shell 422 at the bottom of the receptacle unit 400, and mating shell 426, keyway guide 424, mating keyway 410, and latching indication 434 at the front of the receptacle unit 400. The receptacle housing 402 may comprise any suitable material but in a preferred embodiment may comprise a polymer or polymer composite material to reduce the weight and cost of the receptacle unit 400. When installed on a bulkhead, the flange base 406 would sit flush with the exterior of the bulkhead and the bulkhead shell 422 would extend into the interior of the bulkhead to provide a hermetic seal against exterior conditions. Referring now also to FIG. 15, the mating shell 426 receives the plug mating shell 320 (shown in FIG. 15) and the keyway guide 424 and mating keyway 410 provide for orientation and alignment of the mating key 310 of the plug unit 300 during mating and demating operations. The latching indication 434 on the mating collar 404 provides a clear visual indication of when mating with the plug unit 300 has been fully completed. The latching indication 434 may be high-visibility paint, a reflective surface, a lighted surface, or any other suitable visual indication. When fully mated, the front shell 302 of the plug unit 300 fully covers the latching indication 434 and abuts the mating collar 404 to provide a clear visual indication that the plug unit 300 is fully engaged and properly mated with the receptacle unit 400.

Figure 12:
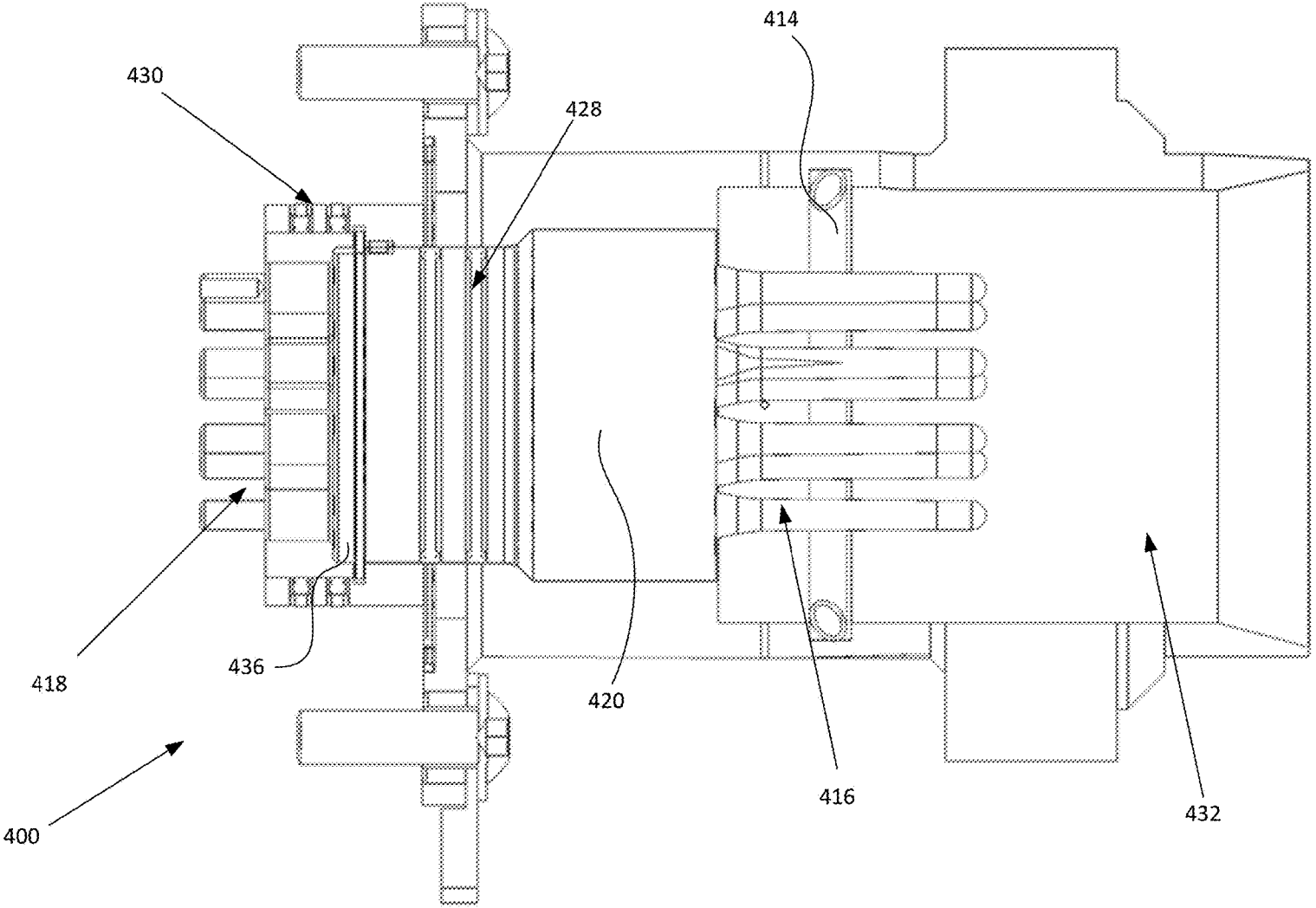
FIG. 12 provides a lateral cross-section view of the receptacle unit 400 according to the present invention.

With reference now to FIG. 12, a lateral cross-section view of the receptacle unit 400 according to the present invention is provided. An electrical module 420 is disposed within the receptacle interior 432 of the receptacle unit 400 and comprises a set of receptacle pins 416 and interior receptacle contacts 418. In another embodiment, the electrical module 420 may comprise a set of plugs instead of the set of receptacle pins 416. The receptacle interior contacts 418 may be connected to any connections with the device or system on which the receptacle unit 400 is installed. For example, the receptacle contacts 418 may be connected to electrical power or data leads such that when the receptacle unit 400 forms a mated connection 600 with the plug unit 300, data or power may pass through the receptacle unit 400 to the plug unit 300 and then to the cables, fibers, or wires of the flying lead 500. Bulkhead shell O-rings 430 on the bulkhead shell 422 provide a seal at a bulkhead on which the receptacle unit 400 is installed. Interior electrical module O-rings 428 provide a seal at the interior of the receptacle unit 400 such that external conditions or contaminants cannot enter past the electrical module 420. The canted-coil latch spring 414 in the receptacle interior 432 secures the plug mating shell 320 within the receptacle unit 400. When the plug unit 300 is fully engaged in a mated condition with the receptacle unit 400, one or more of the mating shell retaining grooves 314 (shown in FIG. 15) will have passed over the canted-coil latch spring 414. When the mating shell retaining grooves 314 pass over the canted-coil latch spring 414 the canted-coil latch spring 414 is compress to allow the mating shell retaining grooves 314 to pass through. However, the mating shell retaining grooves 314, which are substantially wedge shaped having a smaller or narrower front portion gradually extending at an angle to a larger or thicker rear portion, cannot easily pass back over the canted-coil locking spring 414 due to the shape of the mating shell retaining grooves 314 thereby securing the plug unit 300 in a mated condition with the receptacle unit 400 until sufficient force is applied, such as by an ROV, to release the plug unit 300 from the mated condition.

Figure 13:
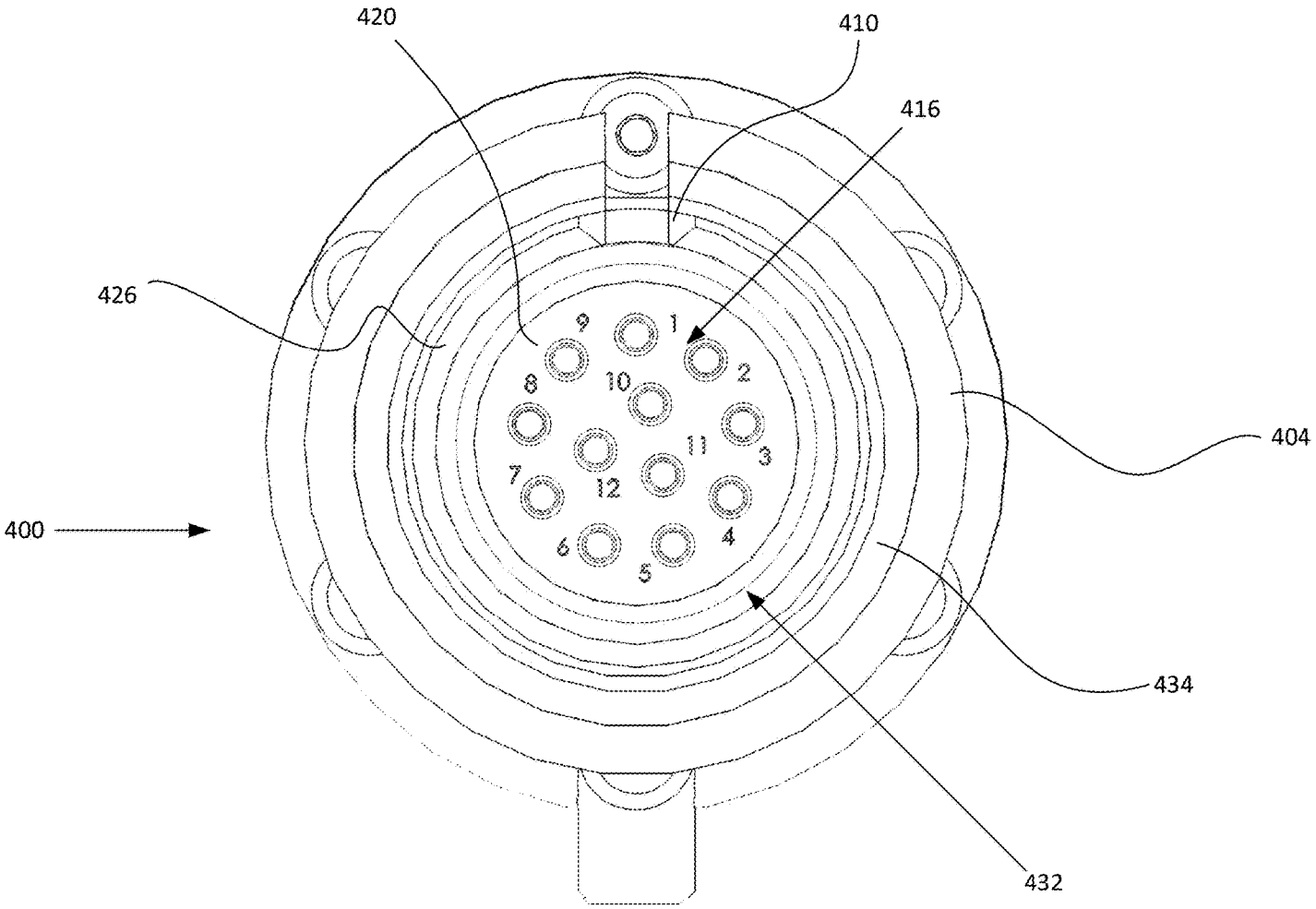
FIG. 13 provides a front view of the receptacle unit 400 according to the present invention.
Figure 14:
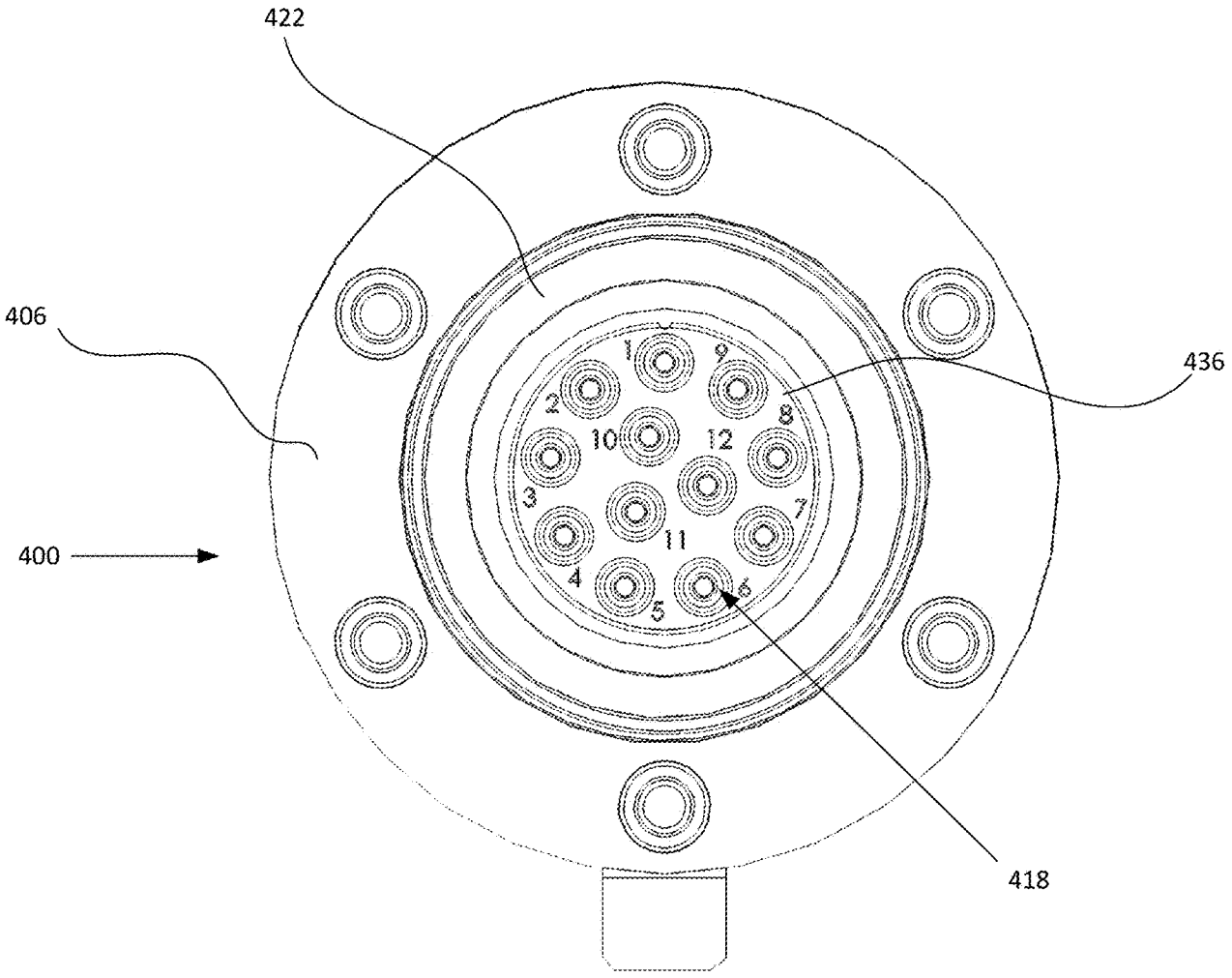
FIG. 14 provides a back view of the receptacle unit 400 according to the present invention.

Referring now also to FIGS. 13 and 14 which provide front and rear views, respectively, of the receptacle unit 400 according to the present invention, the receptacle pins 416 in the electrical module 420 provide for an electrical connection by the plug unit 300 with a device or system connected to receptacle interior contacts 418. The electrical module cap 436, shown in FIG. 14, secures the electrical module 420 within the receptacle unit 400. The plug mating shell 320 of the plug unit 300 is received within the receptacle unit interior 432 and the mating collar 404 serves as a resilient stop for the plug unit 300 during mating operations. The latching indication 434 provides a visual indication of when the plug unit 300 is fully mated with the receptacle unit 400.

With reference now to FIG. 15, a side view of the plug unit 300 according to the present invention is provided. The plug unit 300 comprises a front shell 302, rear shell 304 having rear shell back 312, plug mating shell 320, hose fitting guide 316, hose nut 322, and plug tool pin housing 308 containing the plug tool pin 306. The front shell 302, rear shell 304, and plug mating shell 320 may each comprise a polymer or polymer composite material as each component does not necessarily require the additional strength and stress tolerance that would be provided by a metal composition. The components do not need to be as stress and strain tolerant as the handle typically located on a plug unit has been moved to the reusable mating tool 200 to reduce the complexity and cost of the plug unit 300. A cable pigtail from a flying lead 500 enters the plug unit 300 through the hose fitting guide 316 and the flying lead 500 is secured to the hose nut 322. The cable pigtail would be connected to a set of electrical contacts, which may either be plugs or pins, within the plug unit 300. The electrical contacts would typically be located at or in the plug mating shell 320. The plug mating shell 320 may comprise a set of mating shell vents 324 to provide for the egress of water or other fluids during a mating operation to prevent the buildup of pressures during mating operations. The mating shell retaining grooves 314 operate with the canted-coil latch spring 414 to secure the plug unit 300 in an engaged, mated condition with the receptacle unit 400. The plug tool pin 306 in the plug tool pin housing 308 is acted on by the captured nut assembly 270 of the reusable mating tool to secure the plug unit 300 in the reusable mating tool 200 for mating and demating operations.

While the invention has been described by reference to certain preferred embodiments, it should be understood that numerous changes could be made within the spirit and scope of the inventive concept described. Also, the present invention is not to be limited in scope by the specific embodiments described herein. It is fully contemplated that other various embodiments of and modifications to the present invention, in addition to those described herein, will become apparent to those of ordinary skill in the art from the foregoing description and accompanying drawings. Thus, such other embodiments and modifications are intended to fall within the scope of the following appended claims. Further, although the present invention has been described herein in the context of particular embodiments and implementations and applications and in particular environments, those of ordinary skill in the art will appreciate that its usefulness is not limited thereto and that the present invention can be beneficially applied in any number of ways and environments for any number of purposes. Accordingly, the claims set forth below should be construed in view of the full breadth and spirit of the present invention as disclosed herein.

The invention claimed is:

1. A robotically mateable/dematable connector system for use in subsea environments, the system comprising:

a first connector unit, a second connector unit, and a robotically manipulatable tool;

the first connector unit comprising a housing;

the second connector unit comprising a front shell, a rear shell, and a mating shell disposed within the front shell, the rear shell further comprising a rear shell back;

the robotically manipulatable tool comprising a tool body having a top and a bottom and a tool body opening, and a grip assembly, the grip assembly comprising a grip handle for manipulating the tool by an external force, the robotically manipulatable tool further comprising a captured nut assembly having an interior socket adapted to fit about a matingly configured structure of the second connector unit rear shell back; and wherein the robotically manipulatable tool is releaseably attachable to the second connector unit and, when attached to the second connector unit, is adapted to place the second connector unit in a mated condition with the first connector unit.

2. The system of claim 1 wherein the front shell and the rear shell of the second connector unit comprise a polymer material.

3. The system of claim 1 wherein the first connector unit further comprises a flange base and a mating collar.

4. The system of claim 3 wherein the mating collar of the first connector unit further comprises a mating keyway.

5. The system of claim 4 wherein the mating shell of the second connector unit further comprises a mating key, wherein the mating keyway of the first connector unit is adapted to receive the mating key of the second connector unit to provide for alignment of the first connector unit and second connector unit during a mating operation.

6. The system of claim 3 wherein the mating collar of the first connector unit further comprises a latching indication.

7. The system of claim 3 wherein the mating collar of the first connector unit further comprises a set of tool keys.

8. The system of claim 7 wherein the robotically manipulatable tool further comprises a set of tool keyways configured to receive the set of tool keys.

9. The system of claim 1 wherein the system further comprises a flying lead, the flying lead disposed at and joined to the rear shell of the second connector unit.

10. The system of claim 1 wherein the robotically manipulatable tool further comprises a flying lead guide.

11. The system of claim 1 wherein the housing of the first connector unit comprises one of a polymer material or a metal.

12. The system of claim 1 wherein the mating shell of the second connector unit further comprises a set of locking tabs and the first connector unit further comprises a latching spring disposed within the first connector unit housing, the latching spring adapted to secure the mating shell of the second connector unit within the first connector unit housing in a mated condition.

13. A reusable robotically manipulatable tool comprising:

a tool body having a top and a bottom and a tool body opening;

a grip assembly, the grip assembly comprising a grip handle disposed at the top of the robotically manipulatable tool and joined to the robotically manipulatable tool by a handle collar;

an interior socket adapted to receive a connector unit shell;

wherein the reusable robotically manipulatable tool is further adapted to releaseably attach to a rear shell of a connector unit to provide for the manipulation of the connector unit during a mating or de-mating operation with a bulkhead connector; and wherein the reusable robotically manipulatable tool comprises a captured nut assembly having a threaded interior portion, the threaded interior portion corresponding to and configured to engage with a threaded pin disposed in the connector unit.

14. The reusable robotically manipulatable tool of claim 13 wherein the tool body further comprises a flying lead guide disposed at the bottom of the tool body and adapted to receive a flying lead.

15. The reusable robotically manipulatable tool of claim 13 wherein the tool body comprises a polymer material or a metal.

16. The reusable robotically manipulatable tool of claim 13 wherein the grip assembly further comprises a handle extension and a handle mount block, the handle extension disposed between the grip handle and the handle mount block and the handle mount block disposed on the handle collar.

17. The reusable robotically manipulatable tool of claim 13 wherein the handle collar comprises an upper handle collar and a lower handle collar.

18. The reusable robotically manipulatable tool of claim 13 wherein the tool body comprises a set of tool keyways, the tool keyways adapted to provide for mating alignment with a bulkhead connector during a mating operation.

* * * * *